United States Patent [19]

Bertrand

[11] Patent Number: 4,919,635

[45] Date of Patent: Apr. 24, 1990

[54] TOY CONSTRUCTION ASSEMBLY

[75] Inventor: Vic Bertrand, Ile Bizard, Canada

[73] Assignee: The Ritvik Group Inc., Dorval, Canada

[21] Appl. No.: 286,852

[22] Filed: Dec. 19, 1988

[51] Int. Cl.[5] ..... A63H 33/08

[52] U.S. Cl. ..... 446/128; 446/124

[58] Field of Search ..... 446/128, 85, 124, 120, 446/121; D21/108

[56] References Cited

U.S. PATENT DOCUMENTS

| | | | |
|---|---|---|---|
| 3,005,282 | 10/1961 | Christiansen | 446/128 |
| 3,487,579 | 1/1970 | Brettingen | 446/128 |
| 3,597,875 | 8/1971 | Christiansen | 446/128 |
| 3,716,939 | 2/1973 | Pibet | 446/128 |
| 4,740,189 | 4/1988 | Bertrand | 446/128 |

FOREIGN PATENT DOCUMENTS

| | | | |
|---|---|---|---|
| 50222 | 10/1966 | German Democratic Rep. | 446/128 |
| 8503134 | 6/1987 | Netherlands | 446/121 |
| 2118447 | 11/1983 | United Kingdom | 446/128 |

*Primary Examiner*—Mickey Yu

*Attorney, Agent, or Firm*—Robic, Robic & Associates

[57] ABSTRACT

There is disclosed a construction toy kit including small and large blocks having a hollow open ended box-like base with primary cylindrical outer couplers and inner cylindrical couplers within the base. The size and configuration of these blocks do not allow them to be coupled directly together and the kit includes intermediate blocks capable of so doing.

11 Claims, 5 Drawing Sheets

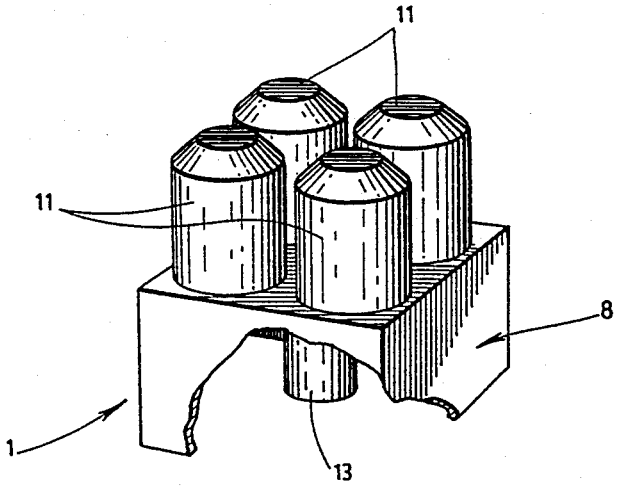
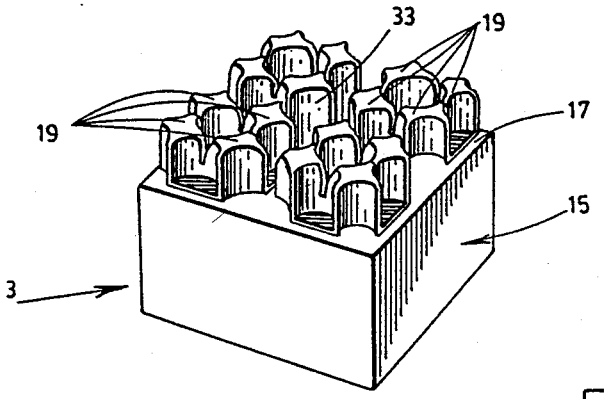
FIG. 3
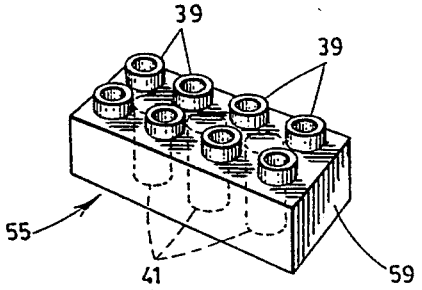

TOY CONSTRUCTION ASSEMBLY

BACKGROUND OF THE INVENTION

1. Field of the Invention

The present invention relates to a toy construction kit comprising small and large building blocks having a hollow open ended box-like base with cylindrical outer couplers and cylindrical inner couplers These blocks cannot be coupled directly together and the kit provides a further block suitable to join them.

2. Description of the Prior Art

The original toy building blocks or bricks of the above general type, better known under the trade mark LEGO and disclosed in U.S. Pat. No. 3,005,282 of Oct. 24, 1961, both in the name of INTERLEGO A.G. are relatively small and are of interest particularly to older children because they are somewhat difficult to handle and to use. A possible disadvantage also is that a large number of them is required if a structure of any reasonable size is to be built. For these reasons, a large block has been devised to be associated and to cooperate to the LEGO block. It is known under the trade mark DUPLO and is the subject of U.S. Pat. No. 3,597,875 of Aug. 10, 1971, both of said trade mark and patent also belonging to INTERLEGO A.G.

More recently, much larger blocks, known under the trade mark MEGA BLOK (see U.S. Pat. No. 4,740,189 of Apr. 26, 1988 to the present Applicant) have come on the market and are quite popular with younger children because of their facility to be handled and used. However, when the child has grown up and has become interested in the DUPLO and LEGO blocks, the MEGA BLOK blocks have to be discarded although they could still be of much interest in certain structures. They have to be set aside because they are not adapted to be coupled with the DUPLO blocks. If the MEGA BLOK block was so adapted, the DUPLO block would then act as an intermediary between the MEGA and LEGO blocks.

Although there are numerous copies of the DUPLO and LEGO blocks presently available in the market under other trade marks such as, for example, TYCO, all the toy construction blocks referred to hereinafter will be identified by the above mentioned trade marks of INTERLEGO A.G., exclusively for simplicity's sake.

SUMMARY OF THE INVENTION

An object of the present invention is to provide an intermediary block, hereinafter called the MEGA PLUS + block, so devised that it can receive a DUPLO block either above or below it.

Another object of the invention lies in providing a toy construction kit offering a greater diversity in the building structures by making it possible to use blocks of varying sizes.

Still another object is to provide a kit of the above type which can grow as the child gets older by starting him with the larger MEGA BLOK and then go on with the DUPLO block, through the MEGA PLUS + block, which DUPLO block makes the use of the LEGO block still possible.

More specifically, the invention proposes an intermediary MEGA PLUS block having a box-like open-ended base with a top wall from which upwardly projects at least one group of four like primary coupling elements disposed around a central axis of said group normal to said top wall; each of said coupling elements having an outer configuration in the form of a polygonal figure comprising one concave wall located proximally with respect to the central axis and at least three outer concave walls located distally with respect to the central axis; the inner concave walls defining four arcs of a common circle spaced from one another and coaxial with said central axis; pairs of said concave outer walls, adjoining one another, creating together lengthwise ridges normal to said top wall.

According to another aspect of the invention, there is provided a toy construction kit which comprises a first block which is of the DUPLO type and has a hollow box-like first base defined by sidewalls, a top wall and an open end facing the top wall; an even number of at least four primary cylindrical like coupling studs projecting upwardly from the top wall and having axes disposed at the four corners of a square and at least one secondary cylindrical coupling stud projecting downwardly from the top wall within the first base, the secondary stud being coaxial with the center of the square.

The kit also comprises a second block which is of the MEGA PLUS + type and has a hollow box-like second base defined by sidewalls, a top wall and an open end facing the top wall; and at least one group of four like primary coupling elements projecting upwardly from the second block top wall and disposed around a central axis normal to the top wall, each of the coupling elements having an outer configuration in the form of a polygonal figure comprising one inner and at least three outer concave walls, the inner concave wall located proximally to the central axis and the outer concave walls located distally with respect to the central axis. The inner diameter is equal to the outer diameter of the secondary stud of the first block.

This second block is constructed so that the secondary stud of the first block is capable of being gripped between its primary coupling elements.

The outer arcuate concave walls of the elements of the second block defining lengthwise ridges. Adjacent sidewalls of the first base have lengthwise corner ribs spaced apart a distance suitable to slide along the ridges of the elements when the secondary stud of the first block is gripped between the coupling elements.

The kit further comprises a third block of the MEGA BLOK type, having a hollow third base defined by sidewalls, a top wall and an open end facing the top wall; an even number of at least four like primary cylindrical coupling plugs projecting upwardly from the third base top wall and having their axes disposed at the four corners of a square, and a secondary cylindrical coupling plug projecting downwardly from the top wall within the third base, the secondary plug being coaxial with the center of the third square; wherein the second hollow base is sized for fitting snugly over at least one of the primary plugs of the third block.

Preferably, the second block, referred to hereinabove, which is the MEGA PLUS + block according to the invention, is a rectangular parallelepiped having two groups of four like coupling elements and an inner central wall in its base. The geometrical projection of this base symmetrically separates the two groups of elements, the central wall dividing the base into two square chambers of equal size. The first block, which is the DUPLO block, is also a rectangular parallelepiped having two groups of four primary cylindrical coupling studs distributed in two rows and disposed at the corners of two squares, constructed so that the two groups of studs are capable of fitting snugly into the chambers of the second block. Advantageously, the DUPLO block has three like cylindrical secondary studs of which the geometrical projections are each tangent to two pairs of its adjacent primary studs. The facing inner concave walls of the coupling elements of the MEGA PLUS + blocks define arcs of three aligned circles of equal diameters also equal to the diameter of the three secondary studs of the DUPLO block, whereby these three secondary studs are capable of being gripped by the coupling elements defining the arcs of the three circles mentioned above about the MEGA PLUS + block.

Other features and advantages of the invention will become apparent from the description that follows of a preferred embodiment having reference to the appended drawings.

BRIEF DESCRIPTION OF THE DRAWINGS

FIG. 3 is an exploded view of a MEGA BLOK, a MEGA PLUS + block and a DUPLO block arrangement according to a modified form;

DESCRIPTION OF THE PREFERRED EMBODIMENT

Figure 1:
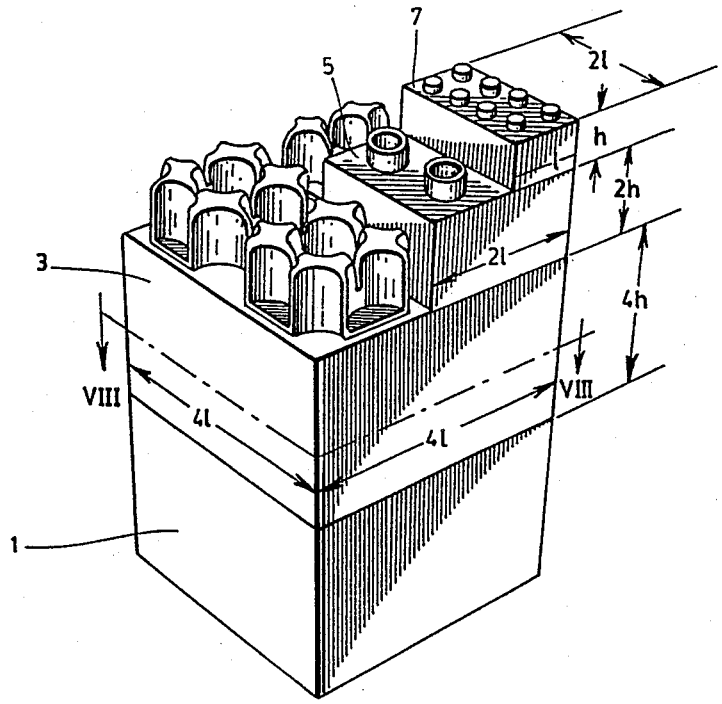
FIG. 1 is a perspective view of an arrangement according to the invention and constituted by a MEGA BLOK, a MEGA PLUS + block, a DUPLO block and a LEGO block.
Figure 2:
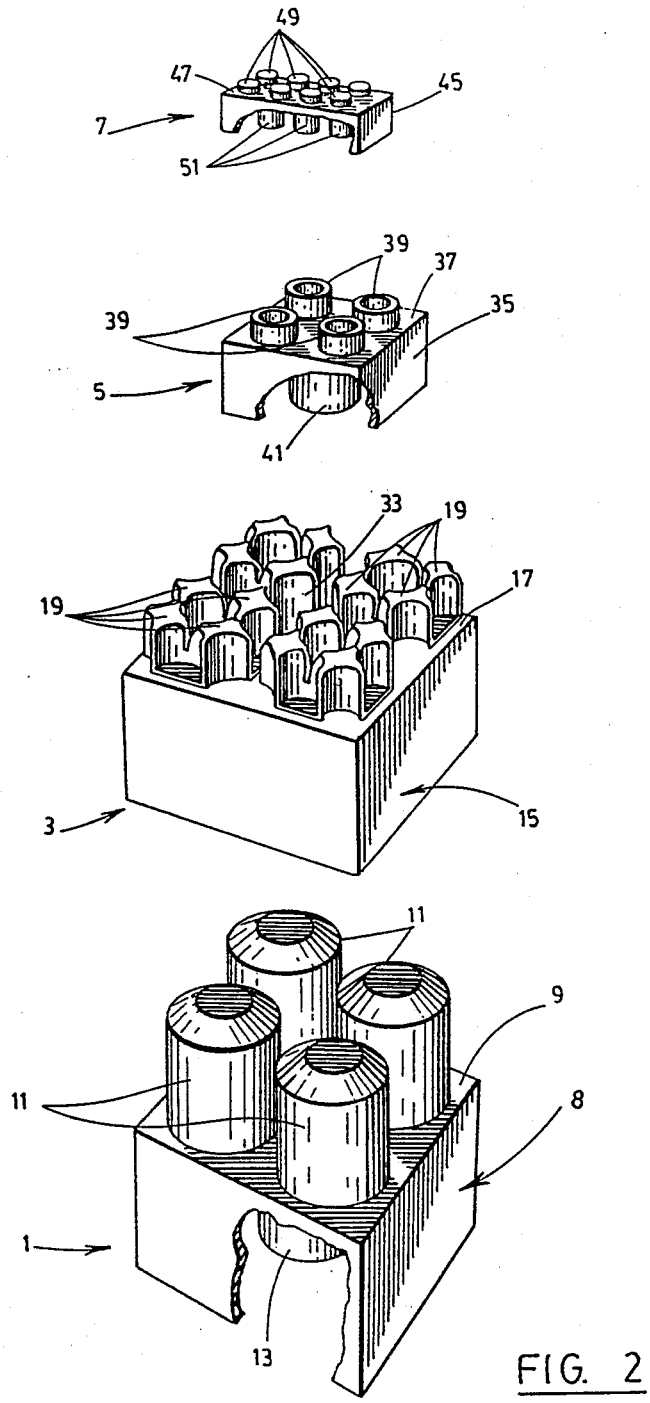
FIG. 2 is an exploded view of the block arrangement of FIG. 1.
Figure 7:
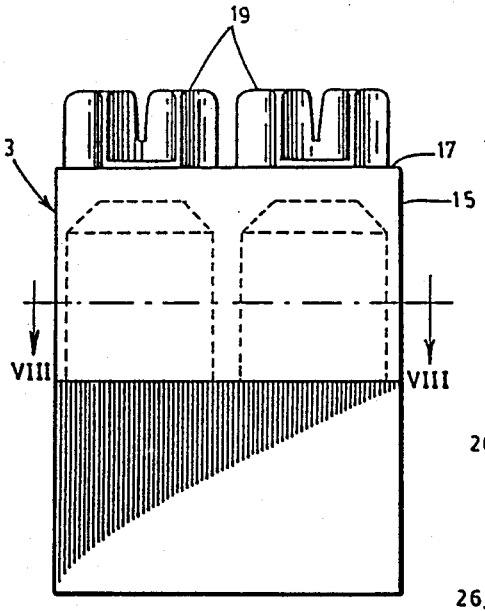
FIG. 7 is a side elevation view of a MEGA BLOK and MEGA PLUS + coupled block combination and FIG. 8 is a cross-sectional view taken along line VIII—VIII of FIGS. 1 and 7.

The building toy block arrangement of FIGS. 1 and 2 is seen to comprise, a MEGA BLOK toy block 1 over which is mounted a MEGA PLUS + followed by a DUPLO block 5 coupled to a LEGO block 7; the latter two blocks 5, 7, being of the type disclosed in the aforesaid U.S. patents.

The MEGA BLOK toy block 1 has a large square hollow box-like base 8 defined by sidewalls, a top wall 9 and an open end facing the top wall 9. Four like. i.e. identical, primary cylindrical coupling plugs 11 project upwardly from the top wall 9 and their longitudinal axes are disposed at the four corners of a square. A secondary cylindrical coupling plug 13 projects down from the top wall 9 into the base 8, being coaxial with the center of the square of the plugs 11.

Figure 8:
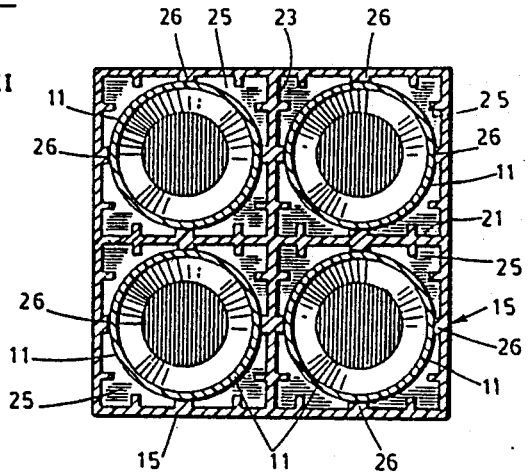
Figure 9:
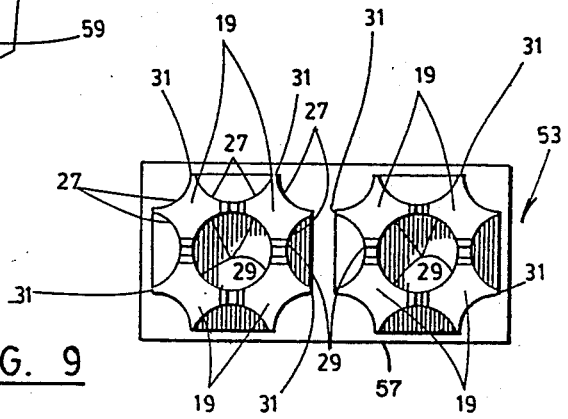
FIGS. 9 and 10 are top and bottom views of a MEGA PLUS + block having two groups of coupling elements.

The MEGA PLUS + block 3 has a large hollow box-like square base 15, of the same size as base 8 of block 1; the base 15 being defined by sidewalls, a top wall 17 and an open end facing the top wall 17. It has four groups, of four primary coupling elements 19, each element being solid with and projecting upwardly from the top wall 17, being further disposed around a central axis normal to wall 17. Each element 19 has a constant cross section with an outer configuration in the form of a quadrilateral figure formed by consecutive concave walls 27, 29 located respectively outwardly and inwardly with respect to the abovementioned central axis, as best seen in FIG. 9 which, however, shows a MEGA PLUS + block having only two groups of four elements 19. As shown also, the inner concave walls 29 of each group of elements 19 define four arcs of a common circle to which reference is made hereinafter. It will further be noted that pairs of adjacent outer concave walls 27 create together lengthwise ridges 31 normal to the top wall 17. Additionally and as best seen in FIG. 8, two inner walls 21, 23, at right angle to one another, are provided in the base 15 and divide it into four square chambers 25. The geometric projections of these inner walls 21, 23, symmetrically separate the four groups of coupling elements 19.

The diameter of the four primary plugs 11 of the MEGA BLOK 1 is selected for snugly fitting each into one of the four chambers 25 of the MEGA PLUS + block. This may necessitate, depending on the thickness of the walls of the base 15, the presence of lengthwise center ribs 26. Also regarding the MEGA PLUS + block, facing concave walls 27 around the center 33 of the block 3, i.e., at the center of the four groups of coupling elements 19, are four arcs of a circle which has the same diameter as that of the secondary coupling plug 13 of the MEGA BLOK 1 so that this plug 13 is capable of being gripped between the said four center concave walls, as would be the case in the combination of FIG. 3.

Figure 6:
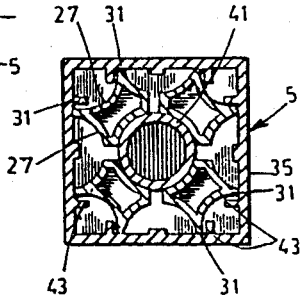

As shown in FIG. 2, the DUPLO block 5, which is of the basic or modular type, has a hollow box-like base 35 defined by sidewalls, a top wall 37 and an open end facing the top wall. As a basic DUPLO block, it has an even number of four primary cylindrical and identical coupling studs 39 projecting upwardly from its top wall; their longitudinal axes being disposed at the four corners of a square. It also has a secondary cylindrical coupling stud 41 that projects below the top wall 37 within the base 35, being coaxial with the center of the above said square. The outer diameter of the stud 41 is equal to that of the aforesaid circle formed by the inner concave walls 29 (FIG. 9) in each of the four groups of concave elements 19 so that the secondary stud 41 can be gripped between the primary elements 19 of any one of the groups. Finally, the adjacent sidewalls of the DUPLO base 35 have lengthwise corner ribs 43 as illustrated in FIG. 6. These ribs are spaced apart a distance suitable for them to slide along the ridges 31 of the elements 19 of the MEGA ALL block when the two blocks are coupled.

Figure 4:
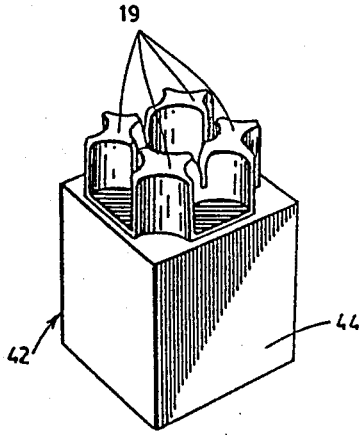
FIG. 4 is a perspective view of a basic or modular MEGA PLUS + block.
Figure 5:
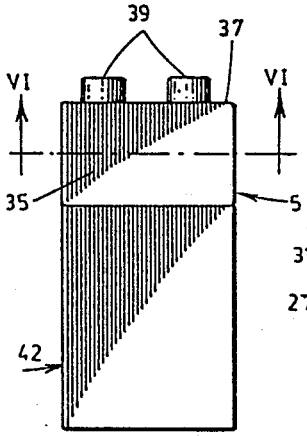
FIG. 5 is a side elevation view of a basic MEGA PLUS + block coupled to a likewise basic DUPLO block and FIG. 6 is a cross-sectional view in a plane along line VI—VI of FIG. 5.

FIG. 4 shows a basic or module type of MEGA PLUS + block 42 having only one group of primarY coupling elements 19. Its base 44 is rectangular in cross-section with its width being half that of the MEGA PLUS + block 3 in FIGS. 2 and 3. In FIG. 5, block 42 is shown coupled, at the top, to a DUPLO block 5 and their cross-section appears in FIG. 6. The sidewalls of the base 44 of the MEGA PLUS + block 42 is inwardly ribbed in the same manner as one quarter of the base 15 in the MEGA PLUS + block 3 of FIG. 8. A similar rib arrangement also appears within the base 35 of the DUPLO block 5 in FIG. 5.

The LEGO block 7 at the top of FIGS. 1 and 2, has a base 45 having a top wall 47 from which project two rows of four primary coupling studs 49 inscribed into three contiguous squares. Beneath the top wall 47 and into the base 45 are three cylindrical secondary aligned studs 51 of which the geometrical projections are tangent each to four primary plugs 49. As known, when coupled to a DUPLO block, the outer two secondary plugs 51 are inserted in two primary tubular plugs 39 of the DUPLO block; the center secondary plug 51 falling in between the plugs 39.

Figure 11:
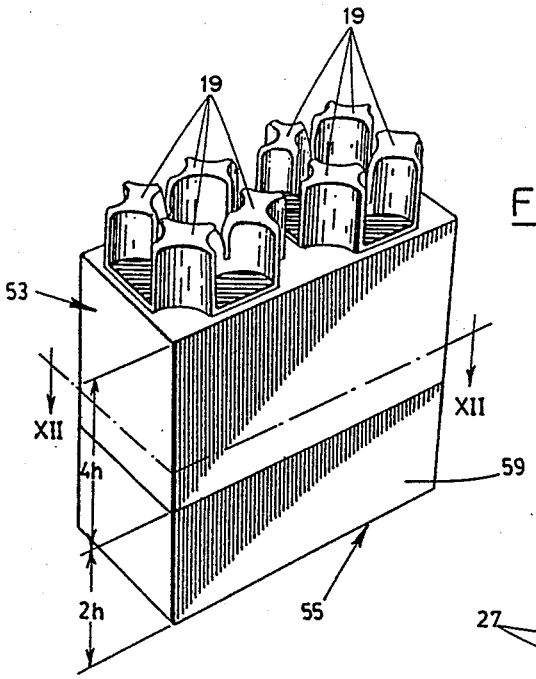
FIG. 11 is a perspective view of a MEGA PLUS + block, as in FIGS. 9 and 10, coupled to a DUPLO block.
Figure 12:
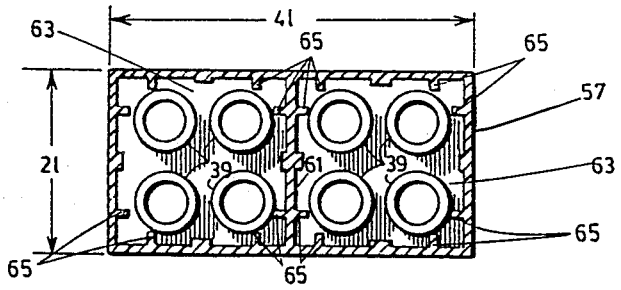
FIG. 12 is a cross-sectional view taken along line XII—XII of FIG. 11.

FIGS. 11 and 12 refer to a combination of a MEGA PLUS + block 53 with a DUPLO block 55 coupled at its lower end; the DUPLO block 55 being detailed at the bottom of FIG. 3. Both are rectangular parallelepipeds. As shown, the base 57 of the MEGA PLUS block 53 is half the size of the base 15 of the MEGA PLUS block 3 in FIGS. 1 and 2, while the base 59 of the DUPLO block 55 is twice the size of the base 35 of the DUPLO block 5 in FIG. 2. The MEGA PLUS + block has two groups of primary elements 31. The DUPLO block 55 has two rows of tubular primary coupling elements 39 and three aligned secondary coupling plugs 41, as shown in FIG. 3.

An inner central wall 61 divides the base 57 of the MEGA PLUS + block 53 into two square chambers 63; the projection of the wall 61 dividing the elements 31 into two symmetrical groups.

As clearly illustrated in FIGS. 3 and 12, there are two groups of four equally spaced tubular primary studs 39 distributed in two rows at the corners of two squares. The construction is such that the two groups are each capable of fitting snugly each into one of the chambers 63. This may necessitate, depending on the thickness of the walls of the base 57 and of the central wall 61, the presence of lengthwise corner ribs 65.

As said above, the DUPLO block 55 has three secondary studs 41 (FIG. 3). The geometrical projections of these studs are each tangent to two pairs of adjacent primary studs 39. On the other hand, facing inner concave walls 29 (FIG. 9) of the MEGA PLUS + block define arcs of three aligned circles of equal diameter, which diameter is also equal to the diameter of the three secondary studs 41 so that the latter may be gripped by the coupling elements 19 forming the arcs of the three aligned circles mentioned above.

Regarding again the outer dimensions of the bases 8, 15 and 35 of the MEGA BLOK, MEGA PLUS + and DUPLO blocks, as in FIGS. 1 and 2, it is seen that, while all bases are square in cross-section, the width and height of the MEGA BLOK and MEGA PLUS + bases 8, 15, are equal and the width and height of the DUPLO base 35 are equal to half those of the bases 8, 15.

In the combination of FIG. 3, the cross-section and size of the bases 8, 15, of the MEGA BLOK and MEGA PLUS + blocks are again the same but the base 59 of the DUPLO block 55 is rectangular in cross-section. Also, while its width is the same as that of the bases 8, 15, its depth and height are only half those of bases 8, 15.

Referring to FIGS. 5 and 6, showing a modular type of DUPLO block 5 mounted on a modular type of MEGA PLUS + block 42, both are rectangular in cross-section and their width are equal. However, the height of the DUPLO block base 35 is only half that of the MEGA PLUS + block base 44.

Figure 10:
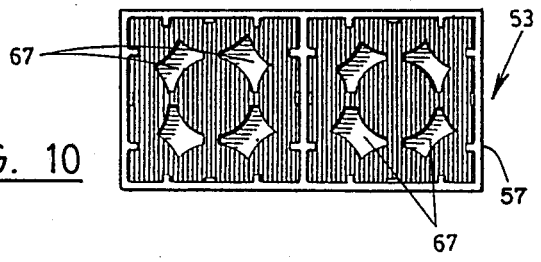

The bottom view of the MEGA PLUS + block 53 in FIG. 10 shows its primary coupling elements 19 to be hollow, as at 67.

The embodiments of the invention in which an exclusive property or privilege is claimed are defined as follows:

1. A toy construction kit comprising;

a first block having a hollow box-like first base defined by sidewalls, a top wall and an open end facing said top wall; an even number of at least four identical primary cylindrical coupling studs projecting upwardly from said top wall, each group of four of said primary coupling studs adjacent each other having axes disposed at the four corners of a first square; and at least one secondary cylindrical coupling stud projecting downwardly from said top wall within said first base, each secondary stud being coaxial with the center of each first square;

a second block having a hollow box-like second base defined by sidewalls, a top wall and an open end facing said top wall; at least one group of four identical primary coupling elements projecting upwardly from said second top wall and disposed around a central axis normal to said top wall, each of said coupling elements having an outer configuration o in the form of a polygonal figure comprising one inner concave wall and at least three outer concave walls, said inner wall located proximally with respect to said central axis and said outer walls located distally with respect to said central axis, said inner concave walls of each group o four coupling elements defining four arcs of a common circle the diameter of which is equal to the outer diameter of said secondary stud of said first block;

wherein said second block is constructed so that said secondary stud of said first block is capable of being gripped between said primary coupling elements of said second block, said outer walls of said primary coupling elements defining lengthwise ridges, and adjacent sidewalls of said first base having lengthwise corner ribs spaced apart a distance suitable for said ribs to slide along said ridges of said elements when said secondary stud of said first block is gripped between said coupling elements; and a third block having a hollow box-like third base defined by sidewalls, a top wall and an open end facing said top wall; an even number equal to at least four of identical primary cylindrical coupling pugs projecting upwardly from said third base top wall, the primary coupling plugs of each group of four of said primary coupling plugs adjacent each other having their axes disposed at the four corners of a third square, and a secondary cylindrical coupling plug projecting downwardly from said top wall within said third base, said secondary plug being coaxial with the center of said third square; and wherein said second hollow base is sized from fitting snugly over at least one of said primary plugs of said third block.

2. A kit as claimed in claim 1, wherein:

said second block is a rectangular parallelepiped having two groups of four identical primary coupling elements and an inner central wall extending perpendicularly to the top wall of said second base inside said second base and disposed so that a geometrical projection of said central wall symmetrically separates said two groups of elements; said central wall dividing said second hollow base into two square chambers of equal size, and said first block is a rectangular parallelepiped having two groups of four primary cylindrical coupling studs distributed in two rows and disposed at the corners of two squares, constructed so that said two groups of studs are capable of fitting snugly into said chambers of said second block.

3. A kit as claimed in claim 2, wherein:

said first block has three like cylindrical secondary studs of which the geometrical projections are each tangent to two pairs of adjacent primary studs of the said first block;

two consecutive outer walls in one of said two groups of primary coupling elements faces two consecutive outer walls in the other of said two groups, said four facing outer walls being each concave and defining together four spaced arcs of a further common circle falling in alignment with and having a diameter equal to the diameter of said common circles of said two groups, said diameter being also equal tot he diameter of said three secondary studs, whereby said three secondary studs are capable of being gripped by said coupling elements of said second block.

4. A kit as claimed in claim 1, wherein:

said second block is a square parallelepiped having four groups of four identical primary coupling elements and two central walls extending inside said second base at right angles to one another and to said second base sidewalls, said central walls dividing said second base into four square chambers of equal size; geometrical projections of said central walls symmetrically separating said four groups of coupling elements, and the size of each of said four square chamber is selected so that each of said chambers fit snugly over one of said primary plugs of said third block.

5. A kit as claimed in claim 4, wherein said four groups of primary coupling elements of said second block are disposed around an axis common to said four groups and wherein said outer walls of said primary coupling elements facing said common axis are concave and define four arcs of a circle having a diameter equal to that of said secondary cylindrical coupling plug of said third block, whereby said secondary plug is capable of being gripped between said four concave walls facing said common axis.

6. A kit as claimed in claim 1, wherein:

said bases of said blocks are square in cross-section;

the width and height of said second base are equal to those of said third base, and the width and height of said first base are equal to half those of said second and third bases.

7. A kit as claimed in claim 1, wherein:

said bases of said second and third blocks are square in cross-section and that of said first block is rectangular;

the width and height of said second base are equal to those of said third base, and the width of said first base is equal to that of said second and third bases and its depth and height are equal to half the width and height of said second and third bases.

8. A kit as claimed in claim 1, wherein:

said bases of said first and second blocks are rectangular in cross-section and their width are equal, and the height of said second base is twice that of said first base.

9. A kit as claimed in claim 4, wherein each wall of said four square chambers is formed with a central rib for guiding said four primary plugs of said third block when slid in said chambers.

10. A kit as claimed in claim 1, wherein said primary coupling studs of said first block are distributed and sized to fit snugly into said second block whenever said primary coupling studs are inserted therein through the open end of said second base.

11. A kit as claimed in claim 10, wherein the second base has a height equal to the one of the third base; and the first base has a height equal to the half the one of said second and third bases.

* * * * *